US005964388A

United States Patent [19]

Jennings et al.

[11] Patent Number: 5,964,388

[45] **Date of Patent: *Oct. 12, 1999**

[54] COIN ROLL WRAPPER CUTTER

[75] Inventors: Dale E. Jennings, 16644 Redwood St., Fountain Valley, Calif. 92708; Scott Ganaja, San Luis Obispo, Calif.

[73] Assignee: Dale E. Jennings, Fountain Valley, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/980,810

[22] Filed: Dec. 10, 1997

[51] Int. Cl.[6] ..... B26B 27/00

[52] U.S. Cl. ..... 225/2; 225/90.4; 225/289; 225/278; 225/286

[58] Field of Search ..... 30/2, 293, 294, 30/280, 90.4, 92.5, 272.1, 314, 289, 112, 286, 278; 83/582, 597, 698.31, 946

[56] References Cited

U.S. PATENT DOCUMENTS

| | | | |
|---|---|---|---|
| 2,050,768 | 8/1936 | Seymour | 30/2 |
| 2,329,805 | 9/1943 | Wilson, Sr. | 30/2 X |
| 2,835,031 | 5/1958 | Cook, Jr. | 30/92.5 X |
| 3,043,004 | 7/1962 | Walter | 30/92.5 |
| 3,781,987 | 1/1974 | Gentscheff | 30/2 |
| 4,001,934 | 1/1977 | Bell | 30/294 X |
| 4,106,196 | 8/1978 | Smithline | 30/294 |
| 4,333,234 | 6/1982 | Smith et al. | 30/2 |
| 4,382,330 | 5/1983 | Harbaugh | 30/2 X |
| 4,825,738 | 5/1989 | Jones | 30/2 X |
| 5,561,903 | 10/1996 | Bourbeau | 30/280 X |
| 5,659,963 | 8/1997 | McCrady | 30/2 X |

FOREIGN PATENT DOCUMENTS

| | | | |
|---|---|---|---|
| 313782 | 6/1929 | United Kingdom | 30/293 |

*Primary Examiner*—Rinaldi I. Rada
*Assistant Examiner*—Boyer Ashley
*Attorney, Agent, or Firm*—Edgar W. Averill, Jr.

[57] ABSTRACT

Coin roll wrapper cutter for assisting in removing the wrapper from a roll of coins. The wrapper cutter has a cutter body which is generally an elongated cylinder. A roll of coins secured by a wrapper is pushed into the top of the cylinder and the side of the roll is contacted by a sharp knife which forms an elongated slit along the wrapper. The slit wrapper easily permits the removal of the coins. Preferably, the knife is spring loaded and moves out sufficiently so that coin rolls of different denominations can be opened by a single size of coin roll wrapper cutter.

9 Claims, 4 Drawing Sheets

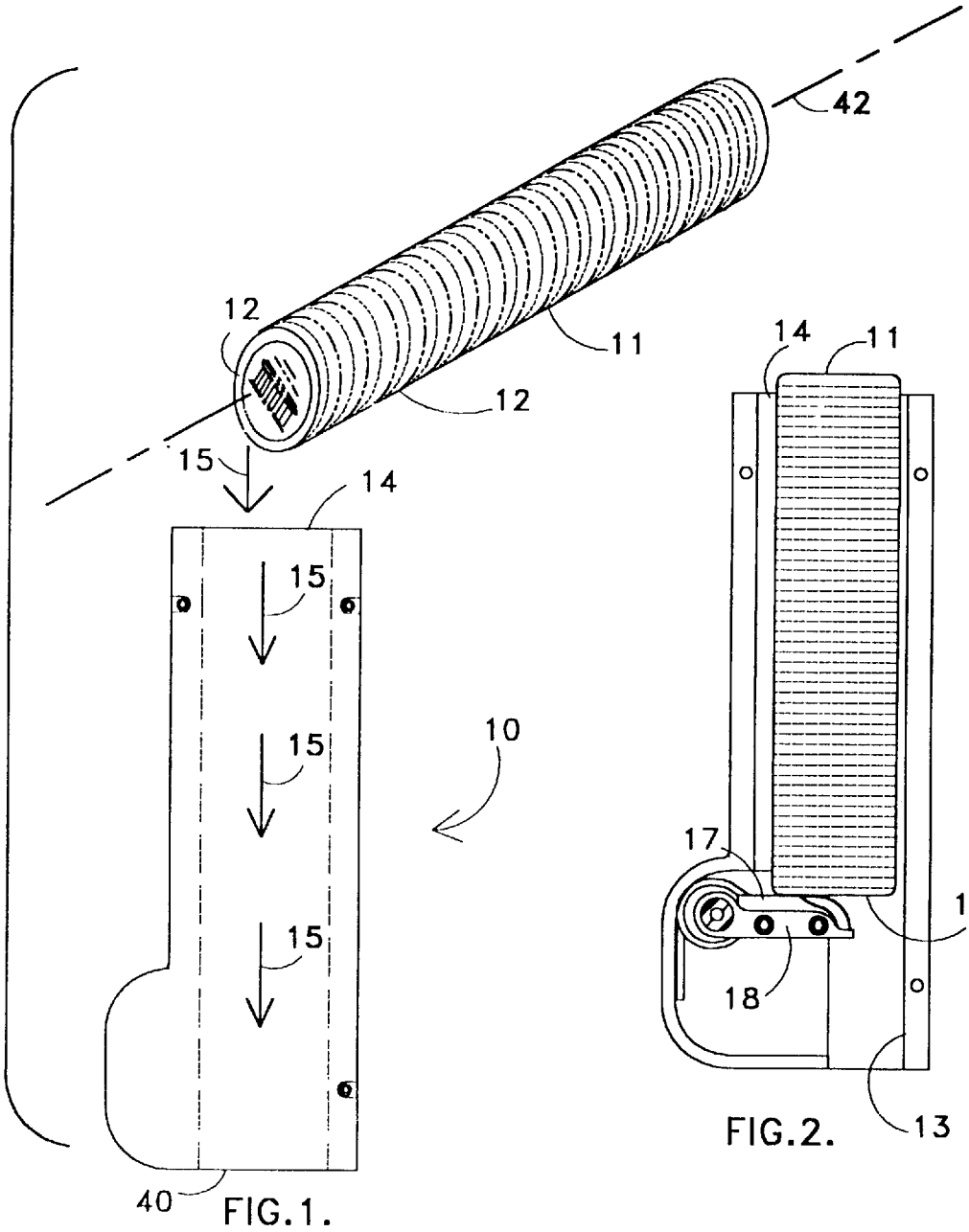
FIG.1.
FIG.2.
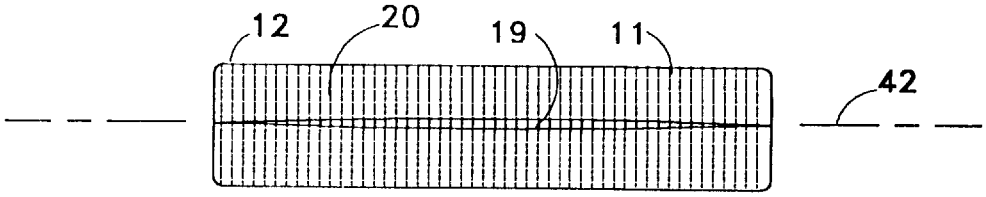
FIG.3.

COIN ROLL WRAPPER CUTTER

BACKGROUND OF THE INVENTION

The field of the invention is devices for facilitating the opening of rolls of coins. For many years, coins have been provided from the bank in rolls, typically of 50 coins. These rolls have been made from kraft paper. Such paper wrapped rolls are relatively easy to open by striking the side of the roll of coins against a sharp edge, thus, breaking the paper wrapper and permitting the coins to fall out.

More recently, shrink wrapped plastic tubes have been used and these tubes do not break so easily. Various cutters have been devised. U.S. Pat. No. 1,959,378 shows a recessed blade which forms a circumferential cut adjacent one end of a fiberboard tube. U.S. Pat. No. 2,050,768, likewise, forms a circumferential cut in a paper tube. Similarly, U.S. Pat. No. 4,382,330 uses blades to cut the crimped end portions from the paper wrapper. Design Patent No. 292,139 shows a coin roll opener which has a rigidly mounted circular blade held with its blade portion held slightly above the floor of the device.

A coin roll cutter is shown in U.S. Pat. No. 4,757,611. This utilizes a blade to form a circumferential cut in the wrapper. U.S. Pat. No. 4,825,738 is concerned with the removal of shrink wrap plastic wrappers. The coin roll is engaged on a corner of the cutter and the roll is rotated which cuts an opening in a generally circumferential manner in the plastic wrapper.

U.S. Pat. No. 4,852,253 utilizes a pair of blades which form a pair of opposed cuts near one end of the roll of coins. Lastly, U.S. Pat. No. 5,123,320 has a blade positioned at the base of a curved surface. The wrapped roll of coins is struck or pressed against the blade which cuts into the roll between adjacent coins. The roll is then more easily opened.

In many of these devices the blade is exposed for potential injury to the user. In others the device is fine for the paper or fiberboard but is incapable of opening the plastic shrink wrap rolls. Because such rolls often need to be opened in a hurry when customers are waiting, the present methods do not provide a reliable opening procedure and there is invariably a great deal of hitting of the roll of coins against the cash register drawer or counter top which can damage either these devices or the cashier's fingers.

BRIEF SUMMARY OF THE INVENTION

It is an object of the present invention to provide a tool which quickly forms a longitudinal cut along a roll of coins and makes it very easy for the user to remove the contents of the roll.

It is another object of the present invention to provide a roll cutter which is capable of operating on coins of different denominations.

The present invention is for a coin roll wrapper cutter which has a cutter body with an elongated central opening. The opening is large enough to permit the passage of a roll of coins from its top and out its bottom. A knife compartment is held within the cutter body adjacent the elongated opening. The knife compartment holds a knife having a blade which contacts the outside of the coin roll wrapper and forms a slit longitudinally along the roll wrapper. Thus, as the roll wrapper is removed from the bottom of the cutter, the elongated slit formed in the wrapper permits the coins to be easily removed from the wrapper. Preferably, the knife is supported by a knife holder which is pivotally held in the knife compartment, preferably the knife holder is spring loaded so that it moves outwardly to contact coin rolls of different sizes. Also, preferably, the knife is held far enough down the holder so that a user's finger cannot touch the knife. Also, preferably, the knife holder is closed on the bottom so that if one reaches in from the bottom of the device, the sharp blade of the knife is not reachable.

BRIEF DESCRIPTION OF THE DRAWINGS

FIG. 1 is an exploded side view showing the coin roll wrapper cutter of the present invention and a wrapped roll of coins above the cutter.

FIG. 2 is a side view of one-half of the cutter of FIG. 1 showing the interior thereof.

FIG. 3 is a top view of a roll of coins having a cut formed therein by the cutter of FIG. 1.

DESCRIPTION OF THE PREFERRED EMBODIMENTS

Figure 4:
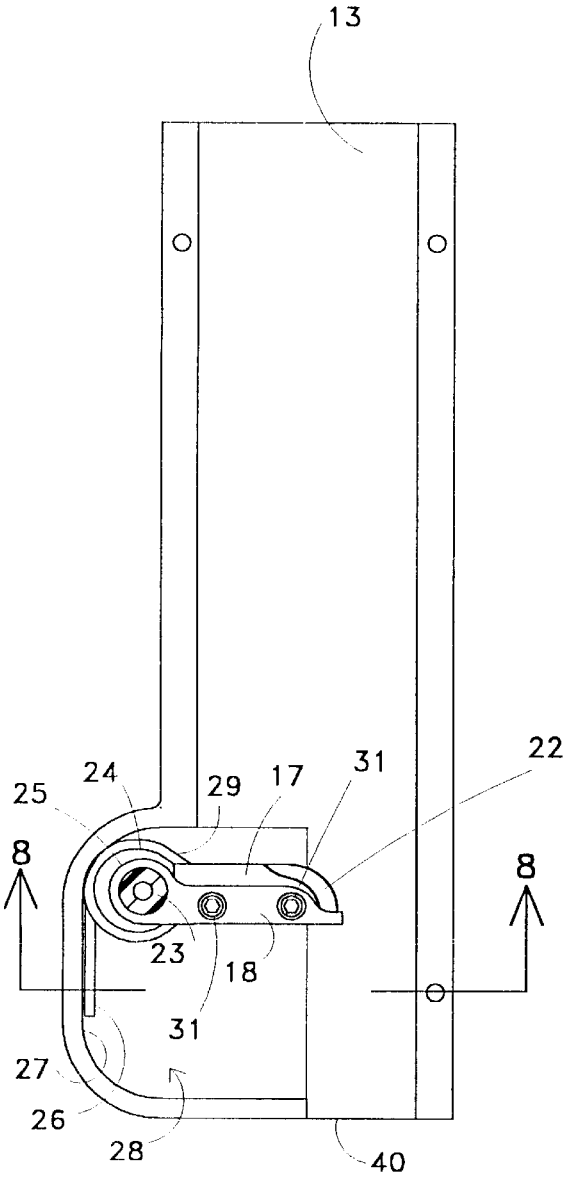
FIG. 4 is a side view of one-half of the cutter of FIG. 1 showing the knife blade and knife holder thereof.

The cutter of the present invention is shown in FIG. 1 and indicated generally by reference character 10. A roll of 50 pennies 11 is shown above cutter 10 and is retained in a shrink )wrap plastic wrapper 12. Each roll of coins has a coin roll longitudinal central axis, such as that indicated by reference character 42 in FIGS. 1 and 3. Such wrappers, although very secure, do not easily split open when struck against the side of a cash register drawer. Cutter 10 is formed from two halves, one half containing the knife holder and knife which is shown in FIG. 2 and indicated generally by reference character 13. The roll of pennies 11 is shown inserted into the open end 14 of cutter 10. Roll 11 is inserted in the direction of arrow 15 in FIG. 1 into the body of cutter 10. Roll 11 passes through cutter 10 in the path indicated by arrows 15 in FIG. 1.

Returning to FIG. 2, the lower end 16 of the roll 11 contacts the upper edge of knife 17 held in a pivotal knife holder 18 shown in FIG. 2. The details of the cutting action will be described below, but the cut 19 formed in roll 11 is shown in FIG. 3. This cut 19 is a longitudinal cut and makes it very easy to remove the coins from the plastic wrapper 20. Of course, the wrapper could be a paper wrapper.

Figure 5:
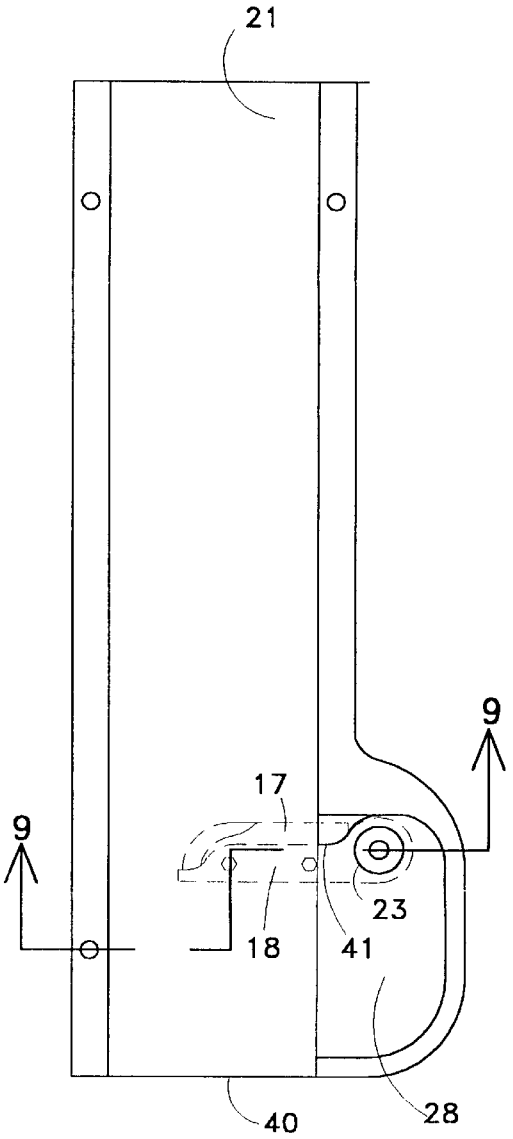
FIG. 5 is a side view of the second half of the cutter of FIG. 1.
Figure 8:
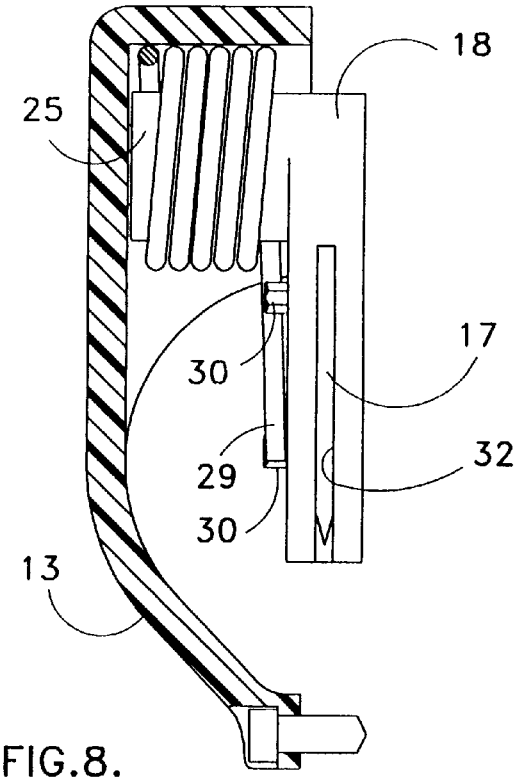
FIG. 8 is a cross-sectional view taken along line 8—8 of FIG. 4.
Figure 9:
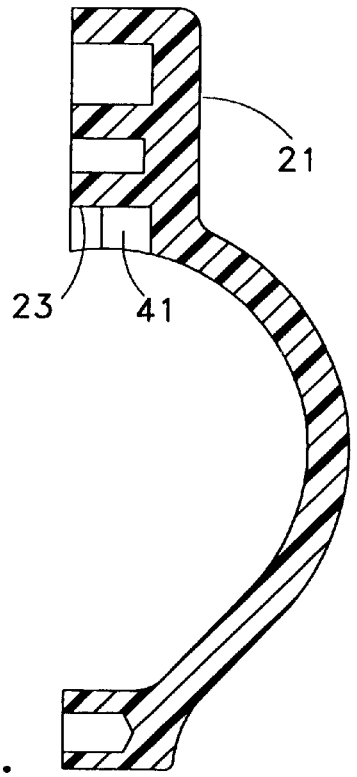
FIG. 9 is a cross-sectional view taken along line 9—9 of FIG. 5.

The details of construction of cutter 10 are shown best in FIGS. 4 and 5 where cutter half 13 is shown in FIG. 4 and cutter half 21 is shown in FIG. 5. A knife blade 17 has a curved sharpened portion 22 near the end thereof. This curved sharpened portion 22 is facing upwardly and outwardly from the holder 18. Holder 18 is pivotally supported on a pair of pegs formed in the cutter halves. One Peg 23 is shown in FIG. 9, and an identical peg is hidden from view in FIG. 8, but can easily be understood to pivotally hold the holder 18.

Figure 10:
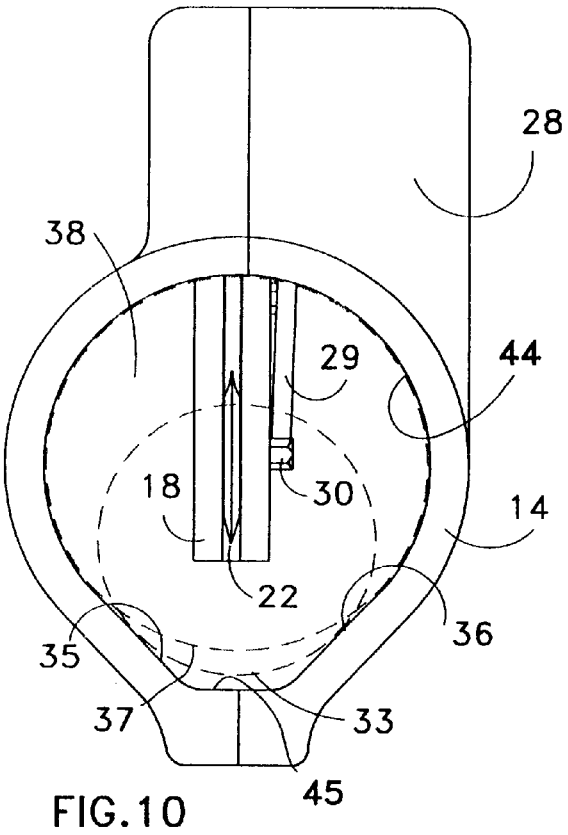
FIG. 10 is top view of the cutter of FIG. 1.
Figure 11:
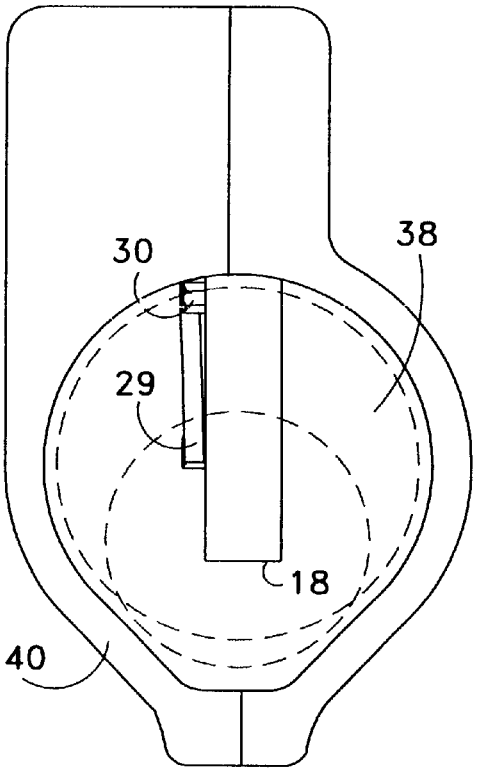
FIG. 11 is a bottom view of the cutter of FIG. 1.

Holder 18 is restrained from further upward turning by its contact with stop 41 shown in half 21 in FIG. 5. Stop 41 abuts one half of holder 18 which can be deduced from viewing FIGS. 10 and 11. A helical spring 24 is wrapped around the cylindrical portion 25 of knife holder 18. Spring 24 has one end 26 which abuts the back 27 of a knife compartment 28 formed in both halves 14 and 21 of cutter 10. The other end of the spring 24 is indicated by reference character 29 and is shown best in FIG. 8 where it can be seen to be held under one of two nuts 30 which, combined with screws 31, squeeze the knife 17 in slot 32 in knife holder 18. The result is that helical spring 24 moves the knife upwardly into a horizontal position as shown in FIG. 4, and yet permits it to pivot downwardly as shown in phantom view in FIGS. 6 and 7 while still urging the knife upwardly.

Figure 6:
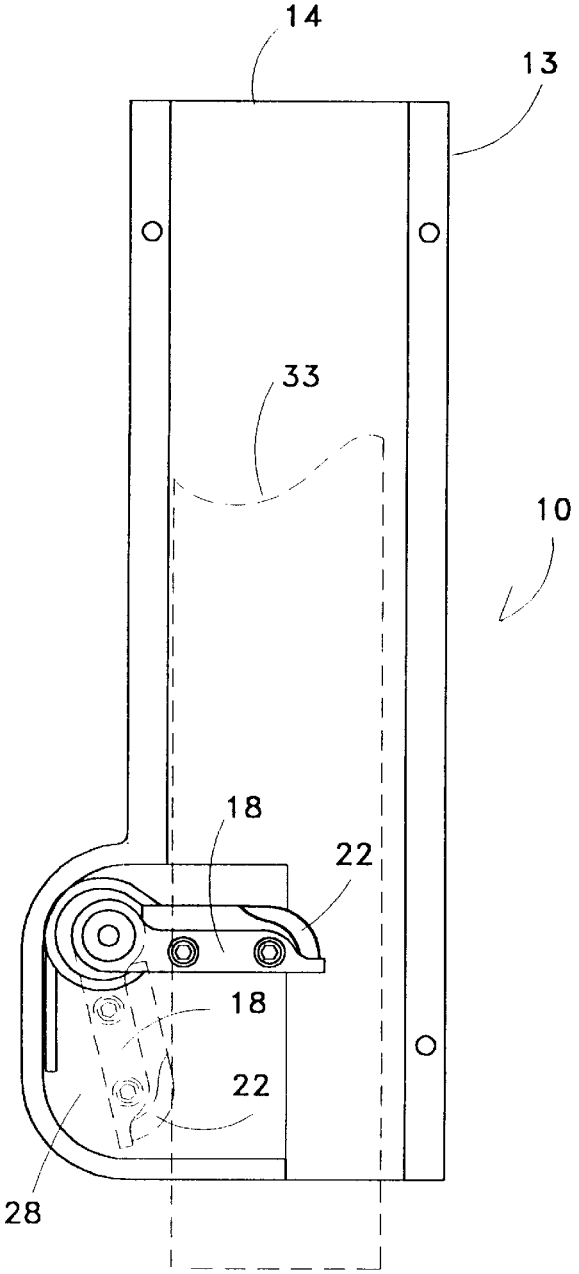
FIG. 6 is a side view analogous to FIG. 4, except that it shows a roll of coins in phantom view and shows the cutter knife rotated downwardly abutting the roll of coins.

Thus, in operation, as shown in FIG. 6, a roll of quarters shown in phantom view and indicated by reference character 33 has been moved into the top 14 of cutter 10. As shown in phantom view, the holder 18 has rotated clockwise from a position of about 3:00 o'clock to one of about 5:30. In this position the curved blade 22 contacts the wrapper which is positioned on the outer edge of the roll of quarters 33 and forms a longitudinal cut therein as shown in FIG. 3. As seen best in FIGS. 10 and 11 of the drawings, the opening, while generally cylindrical, actually is expanded at one portion by a pair of angled edges 35 and 36 which support the roll of quarters in a central position. While the roll of quarters would generally be centered in a cylindrical opening, a roll of dimes 37 would tend to move on the far edge of a cylindrical surface, whereas the angled edges 35 and 36 also hold the roll of dimes 37 in a straight axial orientation along the elongated opening which is indicated generally by reference character 38 in FIGS. 10 and 11. Elongated central opening 38 thus has a central opening inner sidewall surface 44 which is made up of the cylindrical surface, angle surfaces 35 and 36, and a generally flat area 45 between angle surfaces 35 and 36. In the version shown in FIGS. 10 and 11, this provides an inner sidewall surface 44 which completely encircles or surrounds at least a portion of elongated central opening 38.

Figure 7:
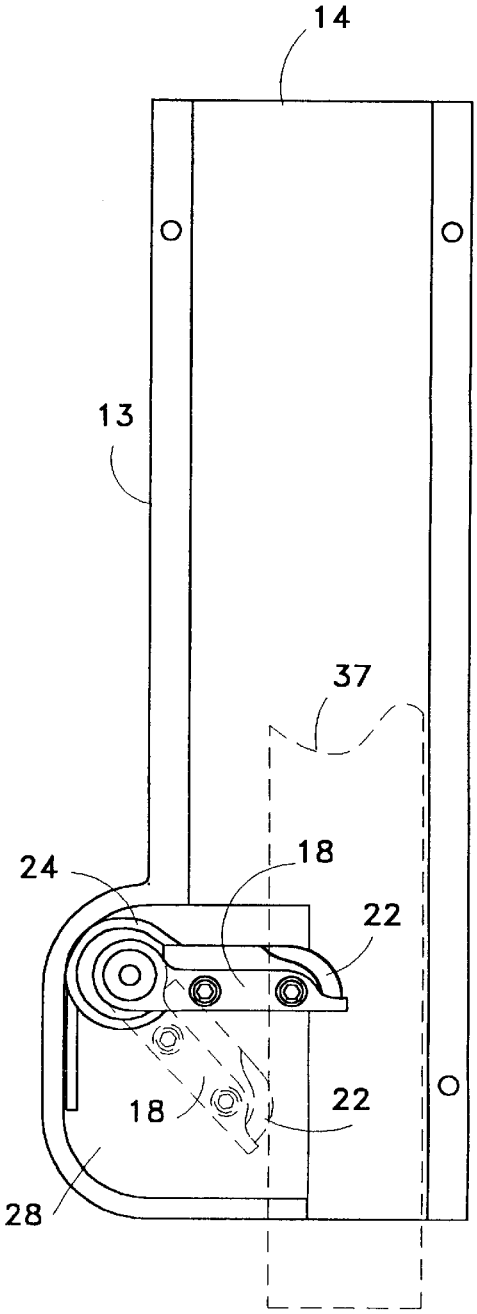
FIG. 7 is a side view of one-half of the cutter analogous to FIG. 6, except that a roll of coins having a smaller diameter is shown.

As shown in FIG. 7, a roll of dimes 37 is further away from the knife blade, but the spring loaded knife holder 18 merely moves counter clockwise from its phantom position shown in FIG. 6 to the position shown in FIG. 7 where the blade 22 is shown being urged against the side of the roll of dimes 37. The spring should be chosen to be sufficiently strong so that it cuts through the wrapper while not being so strong as to force the blade against the coins which would quickly dull it. Obviously, this is a balance and a certain amount of contact of the blade with the coins is inevitable. While the device of the present invention is shown as a disposable device, it is, of course, equally contemplated that it could be taken apart and the blade replaced.

The cutter 10 is also very safe to use for several reasons. First of all, if one were to reach one's finger into the top 14 of cutter 10, the cutter is long enough so that the end of the finger does not reach far enough down to contact the knife 17. If on the other hand, one reaches into the bottom 40 of the cutter 10, as viewed from FIG. 11, the holder 18 extends past the sharpened portion 22 and prevents the user's finger from being cut.

The result is a device which could be easily used to open rolls of coins in sizes including dimes, pennies, nickels and quarters with great ease and great safety. It can, of course, be used for foreign coins and is not limited to the current U.S. coins. The cashier simply inserts the wrapped roll of coins in the direction of arrow 15 in FIG. 1 and the coins fall downwardly from the top 14 out of the bottom 40 from the mere weight of the coins. The roll of coins which exits the bottom 40 is slit as shown in FIG. 3.

While the preferred embodiment is shown in the drawings, it is, of course, not essential that the knife blade be curved, although this is preferred. The preferred blade has the advantage of cutting different sizes of rolls of coins at different points along the curved sharpened portion 22 and thus, tends to dull more slowly. It is anticipated that the cutter would be thrown away when dulled since it can be made very economically. While a generally cylindrical opening is shown in the drawings, it can, of course, be in other shapes, such as in the shape of a polygon with the important feature being that it supports the coins as they are being moved through the cutter. While the cutter is shown as a portable device, it can also, of course, be securely mounted on a counter or on a cash register.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A device (10) for cutting a longitudinal slit (19) in a cylindrical wall portion (20) of a filled coin roll wrapper (12) which said wrapper (12) holds a stack of a plurality of coins (11) of the same denomination said filled coin roll wrapper having a coin roll longitudinal central axis (42), said device (10) comprising:

a cutter body (13, 21) having an elongated central opening (38), said elongated central opening (38) having a top end (14), a bottom end (40), and an inner central opening wall surface (44) that completely encircles at least a portion of the elongated central opening, said elongated central opening (38) being large enough to permit the entire said filled coin roll wrapper (12) to pass in the top end (14), follow a path (15) through said elongated central opening, and to exit out the bottom end (40);

a knife (17) including a blade edge (22) positioned between said top end and said bottom end of said elongated central opening and parallel to said path (15) through said elongated central opening, said knife (17) being supported by said cutter body (13, 21) and said blade edge (22) extending inwardly past said central opening inner wall surface (44) into said elongated central opening (38) at a cutting point within said elongated central opening and said blade edge (22) being positioned substantially into said elongated central opening (38) to contact said cylindrical wall porion (20) as said filled coin roll wrapper (12) follows said path (15) through said elongate central opening (38); and said inner central opening wall surface (44) of said elongated central opening (38) of said cutter body (13,21) including an inner surface area portion (35, 36) configured in a shape to surround the cylindrical wall portion (20) of said filled coin roll wrapper (12) a substantial distance so that said filled coin roll wrapper (12) is prevented from being moved out of said elongated central opening except through said top end (14) or said bottom end (40) and said inner surface area portion (35, 36) guiding the filled coin roll wrapper (12) so that the blade edge (22) must pass against said cylindrical wall portion (20) and make a longitudinal cut (19) in said cylindrical wall portion (20) as said filled coin roll wrapper (12) follows said path (15) whereby the removal of loose coins through said longitudinal cut (19) in the cylindrical wall portion is facilitated.

2. The device of claim 1 wherein said knife (17) is supported by a knife holder (18) which is pivotally held by said cutter body.

3. The device of claim 2 wherein said knife holder (18) is biased so that the blade edge (22) of the knife (17) is urged in a biased manner into said elongated central opening (38).

4. The device of claim 3 wherein said elongated central opening (38) is large enough to permit moving a plurality of denominations of cylindrical rolls of coins longitudinally through said elongated central opening (38).

5. The device of claim 3 wherein said knife is positioned in the knife holder (18) so that the blade edge (22) is oriented toward said top end (14) when the device does not contain a filled coin roll wrapper and said knife holder (18) includes a blade guard portion affixed to said knife holder between said bottom end (40) and said knife blade edge (22) so that the blade edge (22) cannot be touched by a user's finger inserted into the bottom end (40).

6. A tool for facilitating removal of a wrapper from a roll of coins, said roll of coins being a cylindrical stack of coins having a cylindrical coin surface and said wrapper being closely positioned over said cylindrical coin surface to form a filled coin roll wrapper and said wrapper extending over at least a portion of a top roll surface and a bottom roll surface said tool comprising:

a cutter body having an elongated opening having a top end and a bottom end and said elongated opening having an inner side wall surface (44) which completely encircles at least a portion of said elongated opening and forms a path (15) for the passage of said filled coin roll wrapper through said elongated opening, said cutter body having a knife holding compartment adjacent said elongated opening inner side wall surface (44), said knife holding compartment having means for supporting a knife holder supporting a knife, and said elongated opening being large enough to permit passage of the entire filled coin roll wrapper longitudinally through said cutter body into said top end and out of said bottom end;

biasing means held against said knife holder and urging said knife holder in a direction of said path (15); and said knife having a blade edge oriented so that it is about parallel to and points toward said path (15) and said blade edge being urged into said elongated opening by said biasing means and said knife and said knife holder being mounted so that as pressure is exerted downwardly on said knife by said filled coin roll wrapper being inserted into the top end of said elongated opening, said knife will be moved in a direction away from the path (15) by contact with said filled coin roll wrapper and the blade edge will be urged against the side of said filled coin roll wrapper, thereby forming an elongated cut in said wrapper making it easy to remove the coins from the wrapper.

7. The tool of claim 6 wherein said knife blade edge is spaced from the top end of the cutter body so that the blade edge cannot be contacted by a human finger inserted into the top end of said elongated opening.

8. The tool of claim 6 wherein said elongated opening has a circumference portion which is more than 180° which is cylindrical in shape and is large enough to accept a roll of quarters.

9. The tool of claim 8 wherein said knife holder extends a distance into said elongated opening sufficiently so that the knife blade edge will contact a side of a roll of dimes contained in the wrapper, which roll of dimes in a wrapper is passed from the top end to the bottom end of said elongated opening.

* * * * *